US007699562B2

(12) United States Patent
Clark

(10) Patent No.: US 7,699,562 B2
(45) Date of Patent: Apr. 20, 2010

(54) LINER ASSEMBLY FOR A SAND TRAP

(76) Inventor: Kevin L. Clark, 8809 Swan Park, Denton, TX (US) 76210

( * ) Notice: Subject to any disclaimer, the term of this patent is extended or adjusted under 35 U.S.C. 154(b) by 0 days.

(21) Appl. No.: 11/807,690

(22) Filed: May 30, 2007

(65) Prior Publication Data

US 2007/0278142 A1 Dec. 6, 2007

Related U.S. Application Data

(60) Provisional application No. 60/809,564, filed on May 31, 2006.

(51) Int. Cl.
*E02B 11/00* (2006.01)

(52) U.S. Cl. ..... 405/129.75; 405/270

(58) Field of Classification Search ..... 405/50, 405/129.7, 129.75, 129.85, 302.4, 302.6, 405/302.7; 210/170.01
See application file for complete search history.

(56) References Cited

U.S. PATENT DOCUMENTS 4,846,604 A * 7/1989 Holtmann ..... 405/129.5
4,960,345 A * 10/1990 Hurley et al. ..... 405/38
5,147,156 A 9/1992 Guettler et al.
5,256,007 A * 10/1993 Allen ..... 405/302.4
5,263,792 A * 11/1993 Davis et al. ..... 405/45
5,460,867 A * 10/1995 Magnuson et al. ..... 428/178
5,746,546 A 5/1998 Hubbs et al.
5,848,856 A 12/1998 Bohnhoff
6,094,860 A * 8/2000 Motz et al. ..... 47/58.1 R
6,221,445 B1 * 4/2001 Jones ..... 428/17
6,467,991 B1 10/2002 Joyce et al.
6,691,472 B2 * 2/2004 Hubert ..... 52/169.5
6,802,669 B2 * 10/2004 Ianniello et al. ..... 405/50
6,863,477 B2 3/2005 Jenkins et al.
6,877,932 B2 * 4/2005 Prevost ..... 405/38
7,001,111 B2 * 2/2006 Maxwell et al. ..... 405/302.6
7,014,390 B1 * 3/2006 Morris ..... 405/50
7,114,877 B2 * 10/2006 Wilkerson ..... 405/43
7,131,788 B2 * 11/2006 Ianniello et al. ..... 405/50
7,207,747 B1 * 4/2007 England ..... 405/43
7,309,188 B2 * 12/2007 Ianniello et al. ..... 405/129.95
2002/0137871 A1 9/2002 Wheeler et al.
2003/0012604 A1 * 1/2003 Fukui ..... 405/16
2004/0131423 A1 * 7/2004 Ianniello et al. ..... 405/36
2006/0002764 A1 * 1/2006 Legge et al. ..... 405/129.57
2006/0193703 A1 * 8/2006 Carlson et al. ..... 405/302.4

* cited by examiner

*Primary Examiner*—Tara Mayo-Pinnock
(74) *Attorney, Agent, or Firm*—Roeder & Broder LLP; James P. Broder

(57) ABSTRACT

A liner assembly (322) for a sand trap (10) includes a retainer layer (329) that is positioned between a base (18) of the sand trap (10) and a filling material (16) within a cavity (13) of the sand trap (10). The retainer layer (329) is covered by the filling material (16) so that the retainer layer (329) is substantially unexposed. The retainer layer (329) includes a plurality of spaced apart projections (330) that can be formed from plastic, such as synthetic turf material. In certain embodiments, the filling material (16) fills the spaces between the projections (330). The retainer layer (329) can be substantially water impermeable and can cover at least approximately a majority of the surface area of the cavity (13). The retainer layer (329) can be positioned within the cavity at an angle (328) that is at least 10 degrees relative to the horizontal (300).

38 Claims, 3 Drawing Sheets

LINER ASSEMBLY FOR A SAND TRAP

RELATED APPLICATION

This application claims benefit under 35 U.S.C. §119(e) from U.S. Provisional Patent Application Ser. No. 60/809,564, filed May 31, 2006, the entire contents of which are expressly incorporated herein by reference to the extent permitted.

BACKGROUND

Golf technology is advancing at a rapid pace. Equipment has improved, allowing players to hit golf balls farther than ever before, with greater accuracy. In an attempt to keep up with modern golf technology, new golf courses are being constructed and older courses are being renovated to enhance the level of difficulty. As a result of this effort, the number and size of sand traps have increased.

Unfortunately, sand traps require a substantial amount of maintenance and grooming. For example, because sand traps often are positioned near existing grasses, shrubs or other plantings, growth of these plantings can spread into the sand trap, which may be undesirable on certain types of golf courses. Additionally, sand traps can retain water from precipitation and/or irrigation, resulting in slow drainage and/or ponding of water within the sand trap. These types of conditions can result in frustrated golfers or even unplayable conditions, both of which can cause economic losses for golf course owners.

SUMMARY

The present invention is directed toward a liner assembly for a sand trap. The sand trap includes (i) a cavity having a perimeter, (ii) a base within the cavity, and (iii) an exposed filling material, i.e. sand, quartz, etc., positioned within the cavity. In one embodiment, liner assembly includes a retainer layer that is positioned between the base and the filling material. The retainer layer is covered by the filling material so that the retainer layer is substantially unexposed. The retainer layer includes a plurality of spaced apart projections. In certain embodiments, the filling material at least partially fills the spaces between the projections.

In one embodiment, the retainer layer is substantially water impermeable to inhibit movement of water between the base and the filling material. The retainer layer can include a substrate that supports the projections. In this embodiment, the substrate directly contacts the base. In certain embodiments, the cavity has a cavity surface area, and the retainer layer covers at least approximately a majority of the cavity surface area.

The projections can be formed substantially from a plastic material. Additionally, or in the alternative, the retainer layer can be formed at least partially from a synthetic turf material. In another embodiment, the liner assembly further includes a water permeable, first support layer that is at least partially positioned between the retainer layer and base. In yet another embodiment, the liner assembly layer further includes a liquid-applied, substantially water impermeable second support layer that is at least partially positioned between the first support layer and the retainer layer. In some embodiments, at least a portion of the retainer layer is positioned within the cavity at an angle that is at least 10 degrees relative to the horizontal.

The present invention also includes one or more methods for lining the cavity of a sand trap.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
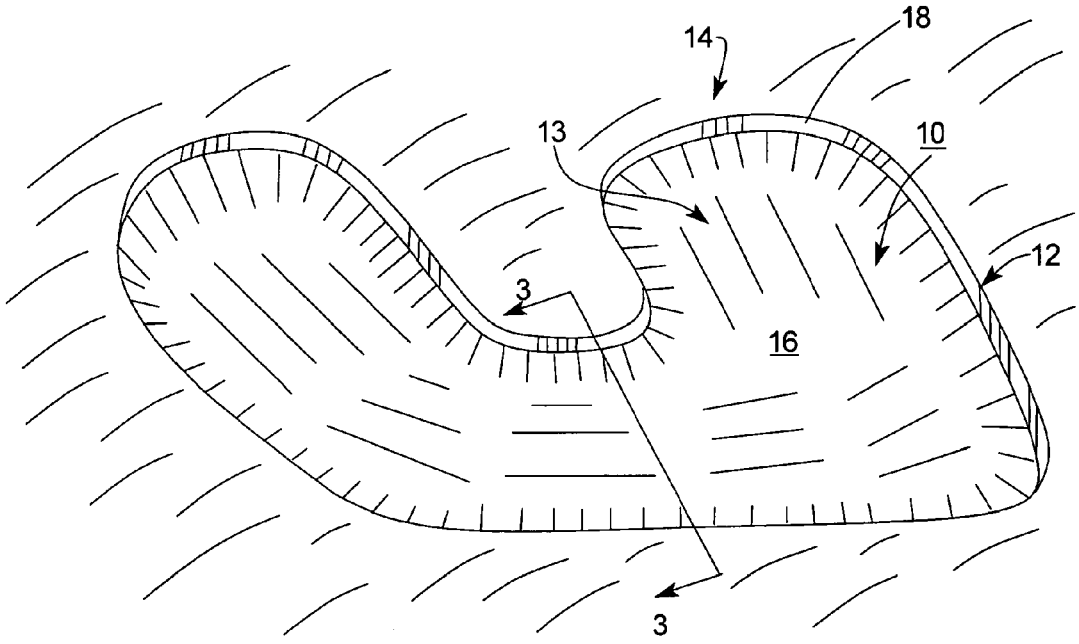
FIG. 1 is a perspective view of a sand trap having features of the present invention.

FIG. 1 is a perspective view of a sand trap 10 having features of the present invention. The sand trap 10 described herein can be used on any type of golf course or any size public or private golf practice facility, as non-exclusive examples. The sand trap 10 illustrated in FIG. 1 has a perimeter 12 that defines a cavity 13 of the sand trap 10, and can be cut into the ground surface 14. The perimeter 12 of the sand trap 10 defines the overall shape or configuration (also known as the footprint) of the sand trap 10. The footprint of the sand trap 10 illustrated in FIG. 1 is merely one example of an infinite number of possible footprints known to those skilled in the art, and is shown as a representative example only.

In this example, the ground surface 14 can be grass or any other type of vegetation. Alternatively, the ground surface 14 can include soil, rock, or other types of non-vegetative materials. In this embodiment, because the sand trap 10 is cut into the ground surface 14, most or all of the sand trap 10 is positioned substantially at or below the level of the ground surface 14, although this is not a requirement. The sand trap 10 also includes a filling material 16 (e.g., sand, quartz, crushed granite or other similar material, sometimes also referred to herein as "sand") and a base 18 that can be native material or imported material from another location. The base 18 can include one or more different types of soil, rock, and/or other suitable materials.

Figure 2:
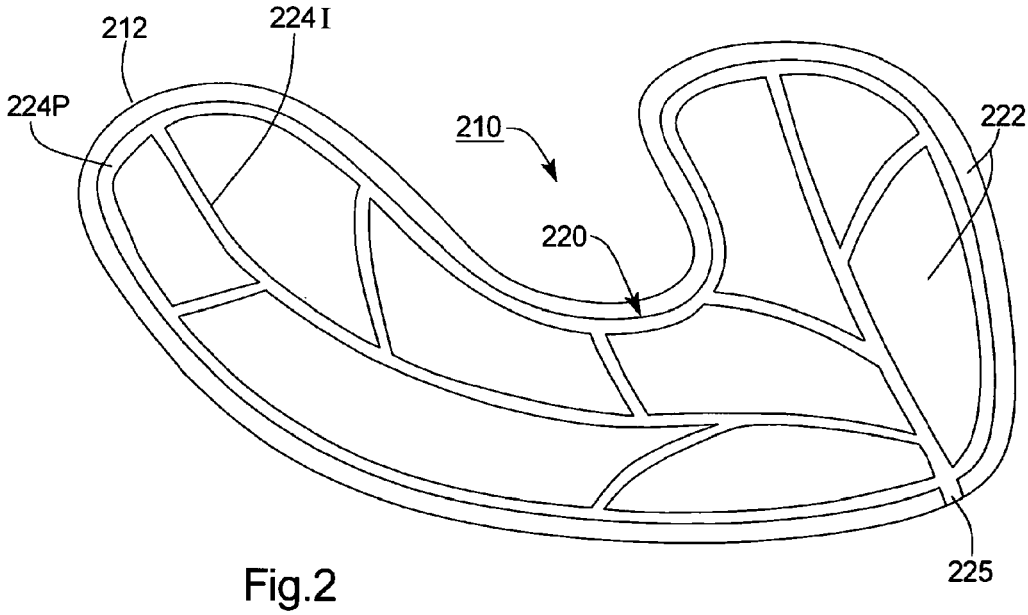
FIG. 2 is a perspective view of a portion of the sand trap.

FIG. 2 illustrates a schematic diagram of a portion of a sand trap 210 having features of the present invention. In this embodiment, the sand trap 210 includes the filling material 16 (illustrated in FIG. 1), the base 18 (illustrated in FIG. 1), a perimeter 212, a drainage system 220 and a liner assembly 222. In the embodiment illustrated in FIG. 2, the filling material 16 has been omitted to show a portion of the drainage system 220 and a portion of the liner assembly 222. The drainage system 220 can include a plurality of interconnected drain lines that include a drain outlet 225, one or more interior drain lines 2241 and one or more perimeter drain lines 224P. It is recognized that the configuration of the drain lines 2241, 224P illustrated in FIG. 2 is merely one example of a drainage network, and that an infinite number of possible configurations could be used that would satisfy the intent of the present invention.

In this embodiment, the perimeter drain line 224P is positioned substantially along or near the perimeter 212 of the sand trap 210. The interior drain lines 224I are positioned more toward an interior of the sand trap 210, i.e. toward the middle area of the sand trap 210 and can extend inwardly from the perimeter 212, for example. Typically, the perimeter 212 of the sand trap 210 is configured to have the greatest degree of slope relative to a horizontal surface. The slope at the perimeter 212 normally induces irrigation water or precipitation to travel downward toward the interior, lesser sloped areas of the sand trap 210, where water can migrate and/or percolate, resulting in ponding. However, the perimeter drain line 224P, either alone or coupled with the liner assembly 222, can inhibit this water migration by causing the water to drain via the drainage system 220 more quickly than with conventional sand traps, as described more fully herein.

Figure 3A:
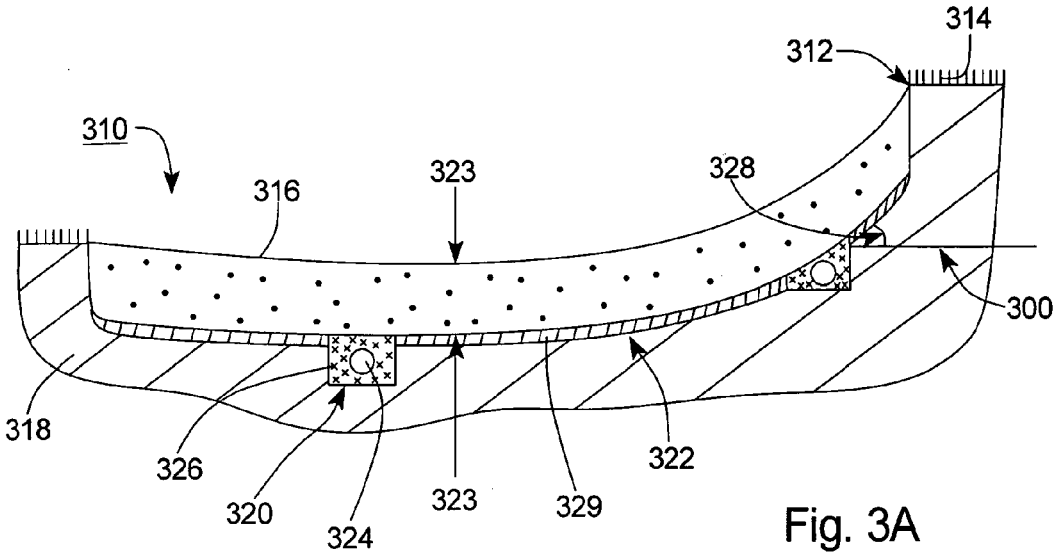
FIG. 3A is a cross-sectional view of the sand trap taken on line 3-3 in FIG. 1, illustrating a first embodiment of a liner assembly having features of the present invention.

FIG. 3A is a cross-sectional view of one embodiment of a sand trap 310 and a portion of the ground surface 314 taken on line 3-3 in FIG. 1. In this embodiment, the sand trap 310 includes the filling material 316, the base 318, a drainage system 320 and a liner assembly 322. In one embodiment, the filling material 316 can have a relatively uniform depth 323 along the length and/or width of the sand trap 310. For example, the filling material 316 can have a uniform depth 323 of between approximately two and eighteen inches, although the depth 323 can be above or below this range. In an alternative embodiment, the depth 323 of the filling material 316 can vary within the sand trap 310.

The base 318 is the material at the bottom and/or sides of the sand trap 310. The base 318 supports, e.g. is positioned beneath, the liner assembly 322. In the embodiment illustrated in FIG. 3A, the base 318 is in direct contact with the liner assembly 322. The base 318 can be formed from any suitable material, including native or imported soils of any type, organic materials, different types of aggregate, various sizes and types of rock, or any other material that forms an appropriate base 318 for the remainder of the contents of the sand trap 310.

In one embodiment, the base 318 is formed by carving out or otherwise removing native ground material to form the cavity 13 (illustrated in FIG. 1). In this embodiment, the base 318 is the material, i.e. soil, rock, etc., that remains following removal of material to form the cavity 13. In an alternative embodiment, known soil amendments, certain aggregates or other materials can be added to the cavity 13 to form the base 318 or combine with the native materials to form the base 318. In yet another embodiment, material is built up to form the desired cavity 13 configuration. Further, the base 318 can be compacted to form a relatively solid base for the remaining materials, described below.

The drainage system 320 can include a network of one or more drain lines 324 that are typically used for landscape drainage. For example, the drain lines 324 can include perforated polyvinylchloride (PVC) pipe, with or without geofabric or some other type of sleeve surrounding the pipe. Alternatively, other suitable types of drain lines 324 or area drains can be utilized with the present invention. In one embodiment, the drain lines 324 can be at least partially surrounded by a drain surround 326 such as crushed or natural rock, sand, or other types of suitable natural or synthetic materials. In certain embodiments, the drain lines 324 can be connected to a drainage outlet 225 (illustrated in FIG. 2), culvert or brow ditch (not shown) or to a sewer system (not shown) that carries the drained fluid away from the filling material 316 within the sand trap 310.

The design of the liner assembly 322 can be varied depending upon the design requirements of the sand trap 310. In certain embodiments, the liner assembly 322 can provide a base upon which at least a portion of the filling material 316 rests. Further, the liner assembly 322 can inhibit the filling material 316 from sliding to lower points within the sand trap 310. For example, on sloped areas of the sand trap 310, the liner assembly 322 provides a structure having sufficient frictional characteristics that allow the sand to resist the force of gravity, and thus, remain on sloped portions of the sand trap 310, such as near the perimeter 312 of the sand trap 310.

In the embodiment illustrated in FIG. 3A, the liner assembly 322 extends substantially along the entire bottom and sides of the sand trap 310. In this embodiment, the liner assembly 322 is positioned adjacent to the base 318. Stated another way, the liner assembly 322 is substantially covered by the filling material 316 so that the liner assembly 322 is substantially unexposed and is therefore not visible to golfers. In the embodiment illustrated in FIG. 3A, the majority of the liner assembly 322 is positioned directly or indirectly between the base 318 and the filling material 316.

Further, as described below, because of the materials used and the method of installation, the liner assembly 322 can be installed at various angles 328 that are significantly greater than zero degrees relative to the horizontal 300. In one embodiment, for example, the angle 328 of the liner assembly 322 can be at least approximately 45 degrees relative to the horizontal 300. In non-exclusive, alternative embodiments, the angle 328 of the liner assembly 322 can be at least approximately 1, 2, 5, 10, 15, 20, 30, 60 or 75 degrees relative to the horizontal 300. In further embodiments, the angle 328 of the liner assembly 322 can be approximately 90 degrees relative to the horizontal 300. With this design, as provided below, the liner assembly 322 can inhibit the sand 316 from sliding down to the lower portions of the sand trap 310 despite an increased angle (relative to the horizontal 300) of portions of the sand trap 310.

In certain embodiments, the liner assembly 322 includes a retainer layer 329 that retains and/or supports a portion of the filling material 316 and inhibits the filling material 316 from sliding downwardly within the sand trap 310. In the embodiment illustrated in FIG. 3A, the retainer layer 329 is in direct contact with the base 318. In one embodiment, the retainer layer 329 can be at least partially formed from a synthetic material, e.g., plastic such as polyethylene and/or polypropylene, which can appear somewhat similar or identical to a synthetic turf material, artificial turf, artificial grass or a synthetic field turf (hereinafter generically referred to as "synthetic turf"). In an alternative embodiment, the synthetic material of the retainer layer 329 can be formed from other types of plastics or any other suitable materials consistent with the intention of the liner assembly 322 described herein. The retainer layer 329 can be water impermeable or water permeable to suit the requirements of the sand trap 310.

In another embodiment, the retainer layer 329 can also include a retainer layer substrate 332 (illustrated in FIG. 3B), such as a geotextile fabric material, a rubberized mat or another suitable material that is adhered or otherwise secured to the synthetic material. Further, in one embodiment, the retainer layer substrate 332 of the retainer layer 329 can be sealed using a material that is substantially water impermeable or resistant to the penetration of liquids. With this design, ground water or other liquids are less likely to percolate into the filling material 316 from or through the base 318. Moreover, because liquid is inhibited from soaking through the liner assembly 322 from the filling material 316, the liner assembly 322 can direct or divert liquids such as precipitation and/or irrigation fluid directly or indirectly into the drainage system 320. Alternatively, the retainer layer substrate 332 can be water permeable to allow water or other liquids to move between the filling material 316 and the base 318, i.e. through the retainer layer 329.

During construction, any seams of the liner assembly 322 can be adhered together using a geotextile fabric with an adhesive material applied to the fabric to reduce the likelihood of breaches in the liner assembly 322.

In addition to the above, the liner assembly 322 can inhibit growth of plants, shrubs, bushes, grass or other vegetation within the sand trap 310. Further, the liner assembly 322 can preserve the integrity of the filling material 316 and/or inhibit infusion and migration of the base 318 into the filling material 316. In addition, or in the alternative, the liner assembly 322 can direct and/or divert water to the drainage system 320 to more quickly evacuate water from the sand trap 310.

Figure 3B:
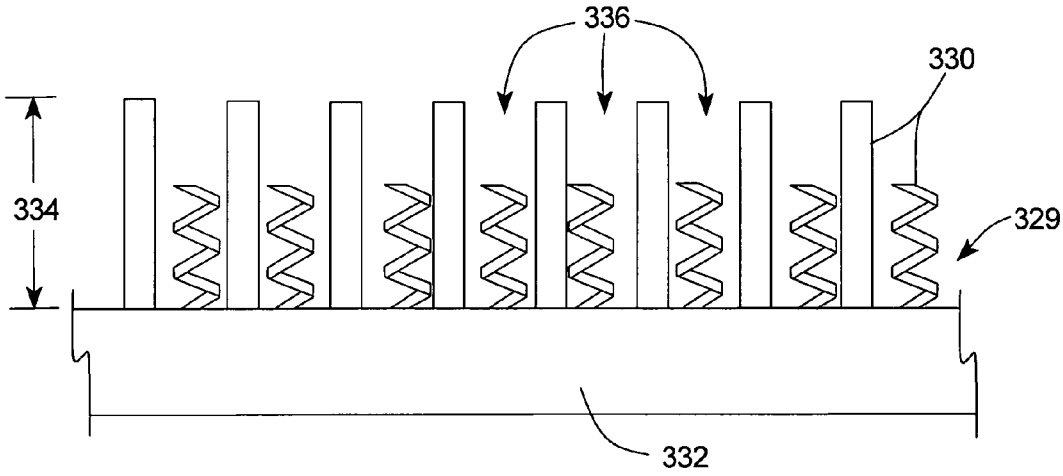
FIG. 3B is a simplified close-up side view of a portion of one embodiment of a retainer layer of the liner assembly.

FIG. 3B is a close-up side view of a portion of one embodiment of the retainer layer 329. In this embodiment, the retainer layer includes a plurality of spaced-apart projections 330 and a retainer layer substrate 332. The projections 330 are secured to and extend from the retainer layer substrate 332. In one embodiment, the projections 330 can approximate blades of grass or turf in size and/or shape. Alternatively, the projections 330 can have a somewhat different size and shape than blades of grass or turf. In non-exclusive alternative embodiments, the projections 330 can be substantially cylindrical, conical, frustoconical, spiral or pyramidal. Still alternatively, the projections 330 can have any other suitable configuration.

The projections 330 can each have a height 334 of approximately 1 to 5 cm. Alternatively, the height 334 of the projections 330 can be greater or less than this range of heights 334. Further, the projections 330 within a given retainer layer 329 can be substantially uniform in height 334. Alternatively, the height 334 of the projections 330 can vary within a particular retainer layer 329. In one embodiment, the height 334 of the projections 330 varies depending upon the positioning of the retainer layer 329 within the sand trap 310 (illustrated in FIG. 3A), including the angle of the retainer layer 329 relative to the horizontal 300 (illustrated in FIG. 3A), proximity to the perimeter 312 (illustrated in FIG. 3A), or other relevant factors that might require a greater or lesser height 334.

In an alternative embodiment, the retainer layer 329 can intersperse projections 330 having disparate heights 334. Alternatively, or in addition, the retainer layer 329 can include two or more different shapes for the projections 330. In the embodiment illustrated in FIG. 3B, the retainer layer 329 includes a plurality of spiral shaped projections 330 interspersed with or separated from a plurality of cylindrical projections 330. By utilizing different shaped and/or sized projections 330, one projection 330 having a first shape can support another projection 330 having a different shape so that the projections 330 are inhibited from laying flat, which would decrease the ability of the retainer layer 329 to support the filling material 316 (illustrated in FIG. 3A) in angled regions of the sand trap 310. The shapes of the projections 330 identified in this example are provided for ease of understanding only, and are not intended to limit the scope of the shapes of projections 330 that can be used in the retainer layer 329.

Additionally, some non-exclusive embodiments of the retainer layer 329 include fibrillated or non-fibrillated products which may be texturized or nontexturized. In certain embodiments, by including projections 330 that extend in an upwardly or outwardly direction relative to the base 318 (illustrated in FIG. 3A) of the sand trap 310, for example, a portion of the filling material 316 can be positioned in the spaces 336 or gaps between the projections 330 of the retainer layer 329, thereby resisting undue gravitational movement of the filling material 316, even on relatively steep sections of the sand trap 310.

In another embodiment, the projections 330 can be coated with an adhesive material (not shown) that can promote adherence of the filling material 316 to the retainer layer 329. With the designs provided herein, the retainer layer 329 remains covered by the filling material 316 so that the retainer layer 329 is unexposed to sunlight and other elements, and is not visible to the golfers.

Figure 4:
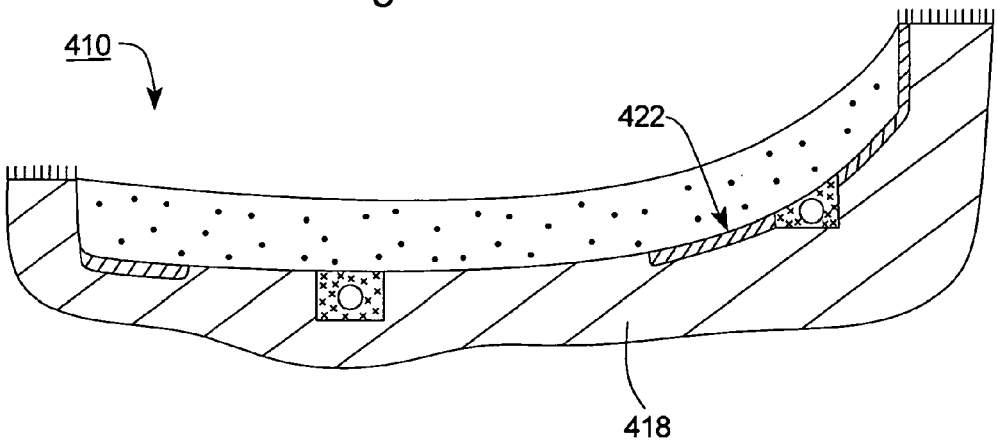
FIG. 4 is a cross-sectional view of the sand trap including a second embodiment of the liner assembly.

FIG. 4 illustrates a cross-sectional view of another embodiment of a portion of the sand trap 410. In this embodiment, the liner assembly 422 is positioned directly on the base 418, but only covers a portion of the base within the sand trap 410. With this design, the cost of the materials forming the liner assembly 422 can be reduced because fewer square feet of these materials are being utilized within a given sand trap 410. Stated another way, the ratio of square footage of the sand trap 410 to the square footage of the liner assembly 422 is greater than 1:1. In non-exclusive alternative embodiments, the ratio of the square footage of the sand trap 410 to the square footage of the liner assembly 422 is at least approximately 2:1, 3:1, 4:1, 5:1, 10:1, 20:1, 50:1 or 100:1.

In another embodiment, the extent to which the liner assembly 422 covers the surface area of the base 418 can vary. For example, in one embodiment, the liner assembly 422 covers at least approximately 2% of the surface area of the base 418. In non-exclusive, alternative embodiments, the liner assembly 422 covers at least approximately 5%, 10%, 25%, 50%, 75% or 90% (or 100% as illustrated in FIG. 3A) of the surface area of the base 418.

In one embodiment, the liner assembly 422 is positioned where it is most needed, e.g., at or near the steepest areas of the sand trap 410. In certain non-exclusive embodiments, the liner assembly 422 is positioned wherever the grade of the sand trap exceeds approximately 1%, 2%, 5%, 10%, 20%, 30%, 45%, 60% or 75%. In another embodiment, the liner assembly 422 is positioned at and/or near the perimeter 412 of the cavity 13 (illustrated in FIG. 1) of the sand trap 410. In one specific embodiment, the liner assembly 422 is positioned in an area that is within approximately two feet or less of the perimeter 412 of the cavity 13. Alternatively or in addition, the liner assembly 422 can alternatively be positioned in an area that is farther away than two feet from the perimeter 412.

Figure 5:
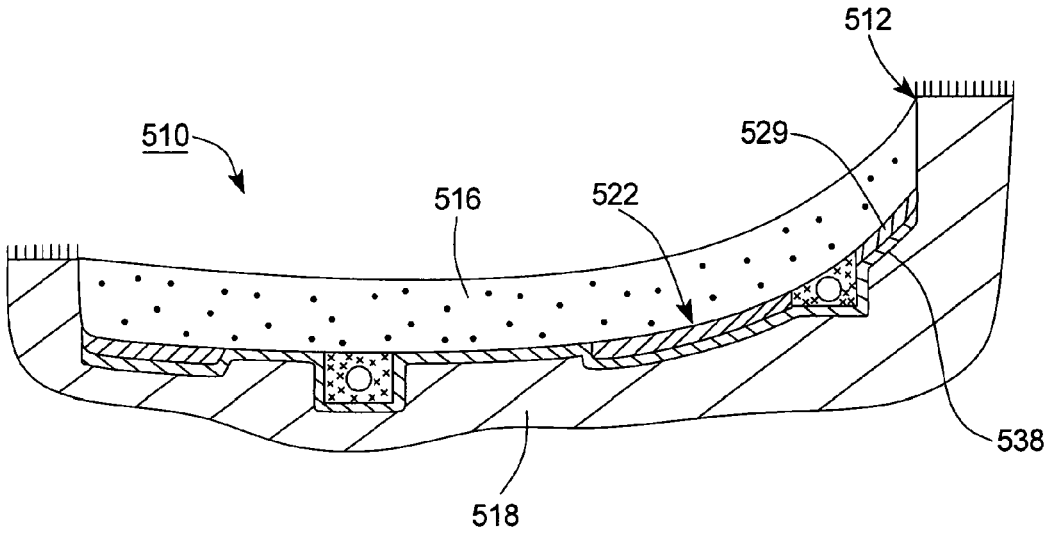
FIG. 5 is a cross-sectional view of the sand trap including a third embodiment of the liner assembly.

FIG. 5 illustrates a cross-sectional view of another embodiment of a portion of the sand trap 510. In this embodiment, the liner assembly 522 includes a retainer layer 529 and a first support layer 538. The first support layer 538 is formed at least partially from a water-permeable fabric material. In one non-exclusive embodiment, the first support layer 538 can be formed from or can include a geosynthetic material such as a geotextile or any other suitable material that resists biological degradation, for example. Alternatively, the first support layer 538 can be formed using another type of material that does not resist biological degradation, as appropriate.

One representative material that can be used for the first support layer 538 includes Mirafi® Filterweave® 404. However, the identification herein of this specific material is not intended to limit the scope of the present invention in any manner, as numerous somewhat similar water-permeable materials can be used for the first support layer 538 of the liner assembly 522. In certain embodiments, the first support layer 538 can be positioned on the base 518 and pinned, stapled, adhered or otherwise held in place on the base 518 within the cavity 13 (illustrated in FIG. 1) of the sand trap 510. Alternatively, the first support layer 538 is simply laid into the cavity 13 without using any type of fastener to hold the first support layer 538 in place.

Although the retainer layer 529 illustrated in FIG. 5 does not cover the entire cavity 13 of the sand trap 510 and is positioned only near the perimeter 512 of the sand trap 510, i.e. only supports a portion of the filling material 516, it is understood that the retainer layer 529 could equally be positioned in a continuous manner within the cavity 13 of the sand trap 510 and/or in areas that are away from the perimeter 512.

Figure 6:
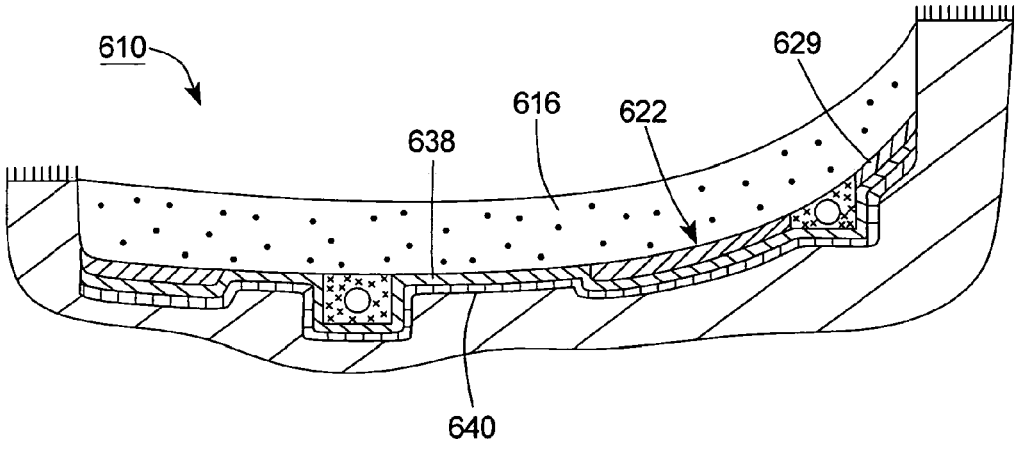
FIG. 6 is a cross-sectional view of the sand trap including a fourth embodiment of the liner assembly.

FIG. 6 illustrates a cross-sectional view of another embodiment of a portion of the sand trap 610. In this embodiment, the liner assembly 622 includes a retainer layer 629, a first support layer 638 and a second support layer 640. In accordance with one embodiment of the liner assembly 622, the second support layer 640 is formed from a substantially water-impermeable material that is secured to the first support layer 638 so that the first support layer 638 is positioned between the base 618 and the second support layer 640. In an alternative embodiment (not shown), the second support layer 640 is indirectly secured to the first support layer 638 so that one or more additional layers (not shown) can be positioned directly between the first support layer 638 and the second support layer 640.

In one embodiment, the second support layer 640 can be seamlessly applied as a liquid to the first support layer 638. For instance, the second support layer 640 can be sprayed onto the first support layer 638 using a compression spray apparatus or other similar type of spraying apparatus, a brush or roller, or by being poured or cast in place, as non-exclusive examples. In this manner, the second support layer 640 can adhere to the first support layer 638 upon curing of the second support layer 640 to form a seamless liner assembly 622. Stated another way, the first support layer 638 can act as a base layer to which the second support layer 640 can adequately bond. A more thorough discussion of the first layer and the second layer can be found in copending U.S. Patent Application entitled "MULTI-LAYER LINER ASSEMBLY FOR A SAND TRAP", filed by Kevin L. Clark, having U.S. patent application Ser. No. 11/188,938. To the extent permitted, U.S. patent application Ser. No. 11/188,938 is incorporated herein by reference.

It is further noted that although the retainer layer 629 illustrated in FIG. 6 does not cover the entire cavity 13 (illustrated in FIG. 1) of the sand trap 610 and is positioned only near the perimeter 612 of the sand trap 610, i.e. only supports a portion of the filling material 616, it is understood that the retainer layer 629 could equally be positioned in a continuous manner within the cavity 13 of the sand trap 610 and/or in areas that are away from the perimeter 612.

While the particular sand trap 10 and liner assembly 222 as shown and disclosed herein are fully capable of obtaining the objects and providing the advantages herein before stated, it is to be understood that they are merely illustrative of the presently preferred embodiments of the invention and that no limitations are intended to the details of the methods, construction or design herein shown and described.

What is claimed is:

1. A liner assembly for a sand trap, the sand trap including a cavity having a perimeter, a base within the cavity and an exposed filling material positioned within the cavity, the liner assembly comprising:

a retainer layer that is positioned between the base and the filling material, the retainer layer being covered by the filling material so that the retainer layer is substantially unexposed, the retainer layer including a plurality of spaced apart projections, wherein the filling material at least partially fills the spaces between the projections; and a separate, water permeable first support layer that is at least partially positioned between the retainer layer and the base.

2. The liner assembly of claim 1 wherein the retainer layer is substantially water impermeable to inhibit movement of water between the base and the filling material.

3. The liner assembly of claim 1 wherein the retainer layer is water permeable to permit movement of water between the base and the filling material.

4. The liner assembly of claim 1 wherein the retainer layer includes a retainer layer substrate that supports the projections, at least a portion of the retainer layer substrate directly contacting the base.

5. The liner assembly of claim 4 wherein the retainer layer substrate is formed from one of the group consisting of a geotextile material and a rubberized mat.

6. The liner assembly of claim 1 wherein the cavity has a cavity surface area, and the retainer layer covers at least approximately 10% of the cavity surface area.

7. The liner assembly of claim 1 wherein the base has a base surface area, and the retainer layer covers a majority of the base surface area.

8. The liner assembly of claim 1 wherein the projections are formed substantially from a plastic material.

9. The liner assembly of claim 1 wherein the retainer layer is formed at least partially from a synthetic turf material.

10. The liner assembly of claim 1 further comprising a liquid-applied, substantially water impermeable second support layer that is at least partially positioned between the first support layer and the retainer layer.

11. The liner assembly of claim 1 wherein at least a portion of the retainer layer is positioned within the cavity at an angle that is at least 10 degrees relative to the horizontal.

12. The liner assembly of claim 1 wherein the filling material is sand.

13. A liner assembly for a sand trap, the sand trap including a cavity having a perimeter, a base within the cavity and an exposed filling material positioned within the cavity, the liner assembly comprising:

a retainer layer that is positioned between the base and the filling material, the retainer layer being covered by the filling material so that the retainer layer is substantially unexposed, the retainer layer being formed at least partially from a synthetic turf; and a first support layer that is at least partially positioned between the retainer layer and the base.

14. The liner assembly of claim 13 wherein the retainer layer is substantially water impermeable to inhibit movement of water between the base and the filling material.

15. The liner assembly of claim 13 wherein the retainer layer is water permeable to permit movement of water between the base and the filling material.

16. The liner assembly of claim 13 wherein at least a portion of the retainer layer directly contacts the base.

17. The liner assembly of claim 13 wherein the synthetic turf material of the retainer layer is at least partially secured to a geotextile material.

18. The liner assembly of claim 13 wherein the base has a base surface area, and the retainer layer covers at least approximately 10% of the base surface area.

19. The liner assembly of claim 13 wherein the base has a base surface area, and the retainer layer covers a majority of the base surface area.

20. The liner assembly of claim 13 wherein the retainer layer is formed substantially from a plastic material.

21. The liner assembly of claim 13 wherein at least a portion of the retainer layer is positioned near the perimeter of the cavity.

22. The liner assembly of claim 13 further comprising a second support layer that is at least partially positioned between the first support layer and the retainer layer.

23. The liner assembly of claim 22 wherein the first support layer is water permeable.

24. The liner assembly of claim 22 wherein the second support layer is substantially water impermeable.

25. The liner assembly of claim 13 wherein at least a portion of the retainer layer is positioned within the cavity at an angle that is at least 10 degrees relative to the horizontal.

26. The liner assembly of claim 13 wherein the filling material is sand.

27. The liner assembly of claim 13 wherein the retainer layer is formed at least partially from synthetic turf.

28. The liner assembly of claim 13 wherein the retainer layer includes a retainer layer substrate that supports the projections, at least a portion of the retainer layer substrate directly contacting the base, the retainer layer substrate being formed from one of the group consisting of a geotextile material and a rubberized mat.

29. A method for lining a cavity of a sand trap, the method comprising the steps of:

providing a retainer layer having a plurality of spaced-apart, substantially upright projections;

positioning at least a portion of the retainer layer between a base of the cavity and an exposed filling material so that the retainer layer substantially covered by the filling material, the filling material at least partially filling a space between the plurality of projections; and positioning at least a portion of a water permeable first support layer between the retainer layer and the base.

30. The method of claim 29 wherein the filling material is sand.

31. The method of claim 29 wherein the step of providing includes forming the retainer layer at least partially from a synthetic turf material.

32. The method of claim 29 wherein the step of positioning at least a portion of the retainer layer includes positioning at least a portion of the retainer layer in direct contact with the base of the cavity.

33. A liner assembly for a sand trap, the sand trap including a cavity having a perimeter, a base within the cavity and an exposed filling material positioned within the cavity, the liner assembly comprising:

a retainer layer that is positioned between the base and the filling material, the retainer layer being covered by the filling material so that the retainer layer is substantially unexposed, the retainer layer including a plurality of spaced apart first projections having a first shape and a plurality of spaced apart second projections having a second shape that is different than the first shape.

34. The liner assembly of claim 33 wherein the retainer layer is substantially water impermeable to inhibit movement of water between the base and the filling material.

35. The liner assembly of claim 33 wherein the retainer layer is water permeable to permit movement of water between the base and the filling material.

36. The liner assembly of claim 33 wherein the retainer layer includes a retainer layer substrate that supports the projections, at least a portion of the retainer layer substrate directly contacting the base.

37. The liner assembly of claim 33 further comprising a first support layer that at least partially positioned between the retainer layer and the base.

38. The liner assembly of claim 37 wherein the first support layer is water permeable.

* * * * *

UNITED STATES PATENT AND TRADEMARK OFFICE

CERTIFICATE OF CORRECTION

PATENT NO. : 7,699,562 B2
APPLICATION NO. : 11/807690
DATED : April 20, 2010
INVENTOR(S) : Kevin L. Clark It is certified that error appears in the above-identified patent and that said Letters Patent is hereby corrected as shown below:

Column 8, Line 48, insert the word -- material -- after the word "turf".

Signed and Sealed this

Sixth Day of July, 2010

David J. Kappos

David J. Kappos
*Director of the United States Patent and Trademark Office*